US005642769A

United States Patent [19]

Thöne et al.

[11] Patent Number: 5,642,769

[45] Date of Patent: *Jul. 1, 1997

[54] CONTINUOUS CASTING MOLD

[75] Inventors: Heinrich Thöne, Losenstein; Franz Wimmer, Riedau, both of Austria

[73] Assignee: Voest-Alpine Industrieanlagenbau GmbH, Austria

[*] Notice: The term of this patent shall not extend beyond the expiration date of Pat. No. 5,623,983.

[21] Appl. No.: 571,071

[22] Filed: Dec. 12, 1995

[30] Foreign Application Priority Data

Dec. 21, 1994 [AT] Austria ..... 2379/94

[51] Int. Cl.[6] ..... B22D 11/04; B22D 11/16

[52] U.S. Cl. ..... 164/416; 164/418; 164/154.1

[58] Field of Search ..... 164/416, 418, 164/459, 478, 452, 154.1

[56] References Cited

U.S. PATENT DOCUMENTS

| | | | |
|---|---|---|---|
| 5,350,005 | 9/1994 | Sorimachi et al. | 164/416 |
| 5,458,182 | 10/1995 | Aoki et al. | 164/416 |
| 5,505,249 | 4/1996 | Scheurecker et al. | 164/416 |

FOREIGN PATENT DOCUMENTS

| | | |
|---|---|---|
| 383521 | 12/1985 | Austria . |
| 0150357 | 12/1984 | European Pat. Off. . |
| 2248066 | 9/1972 | Germany . |
| 3635949 | 10/1985 | Germany . |
| 3714549 | 4/1987 | Germany . |
| 4023672 | 7/1990 | Germany . |

*Primary Examiner*—Joseph J. Hail, III
*Assistant Examiner*—L.-H. Lin
*Attorney, Agent, or Firm*—Ostrolenk, Faber, Gerb & Soffen, LLP

[57] ABSTRACT

A continuous casting mold includes an oscillation mechanism and a guiding mechanism supporting the continuous casting mold relative to a stationary supporting structure, the guiding mechanism being formed as a disc-shaped spring. In order to ensure perfect guidance by employing a simply structured oscillation mechanism and to markedly reduce the masses to be moved, at least one disc-shaped spring formed as an annular disc peripherally surrounds the continuous casting mold, which annular disc by the inner edge region is connected with the continuous casting mold and by the outer edge region is connected with the stationary supporting structure.

20 Claims, 2 Drawing Sheets

FIG. 1
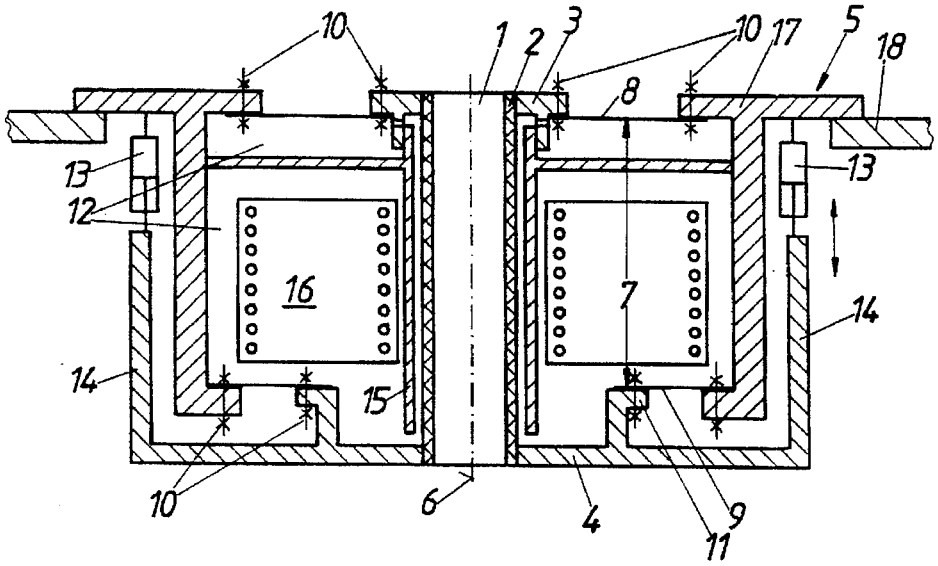
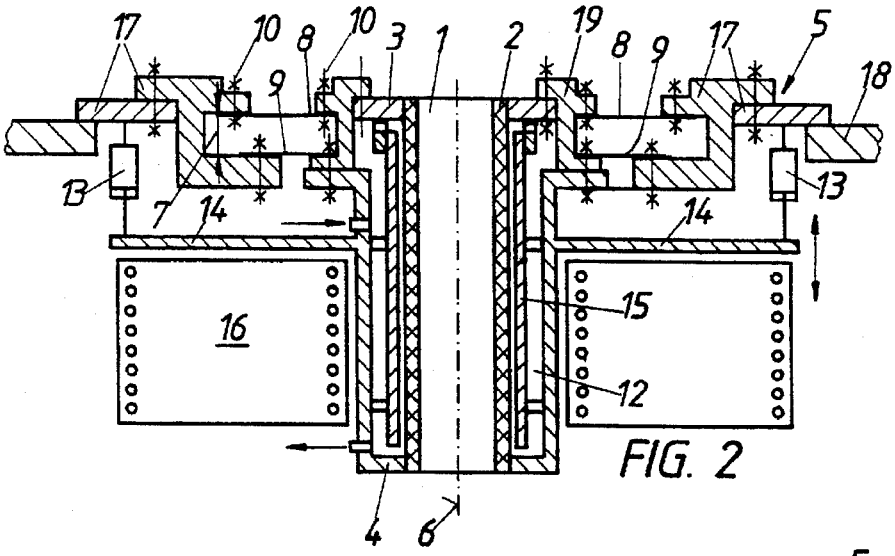
FIG. 2
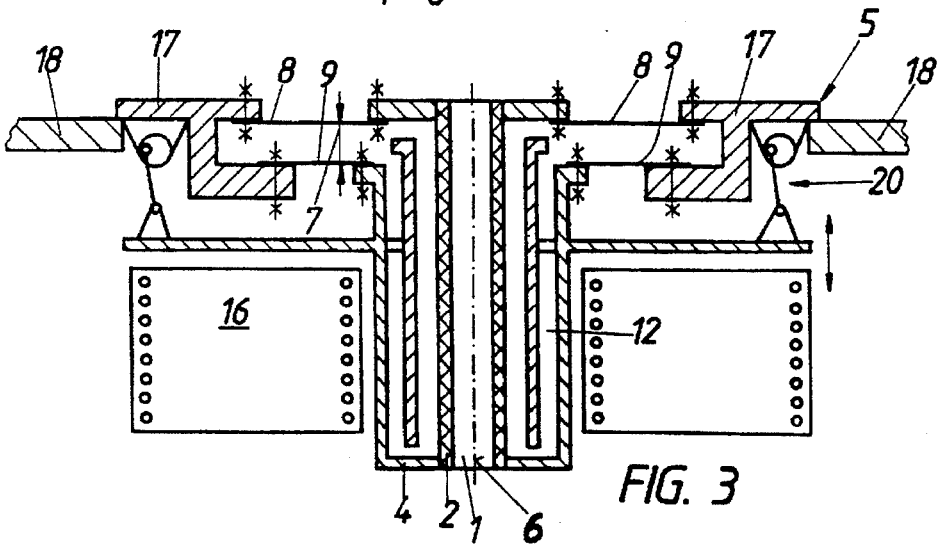
FIG. 3

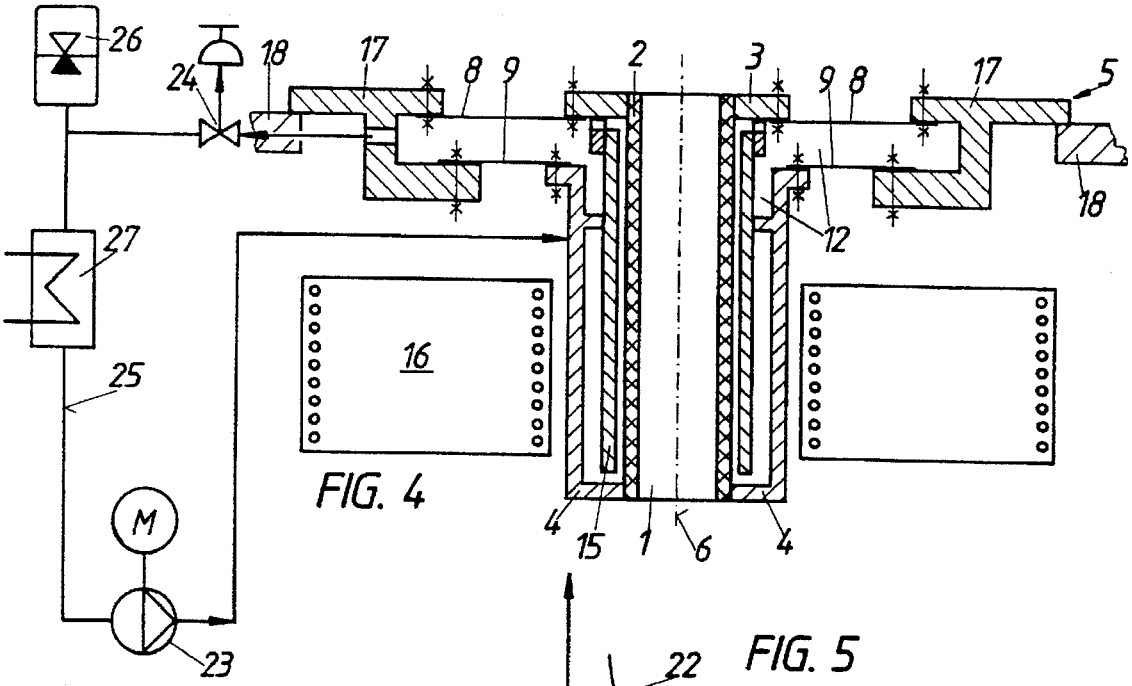
FIG. 4
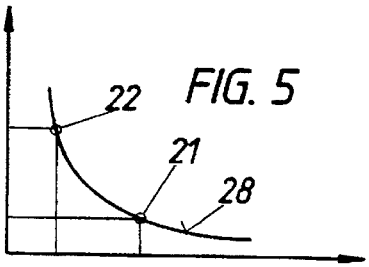
FIG. 5
FIG. 6
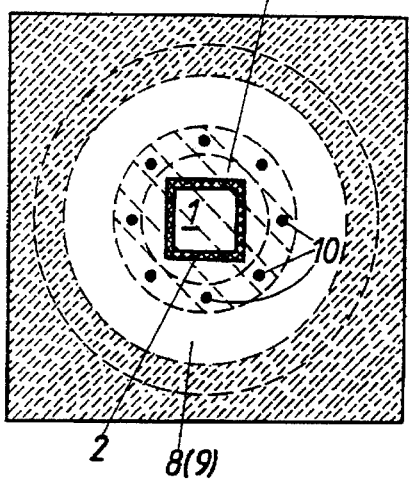
FIG. 7
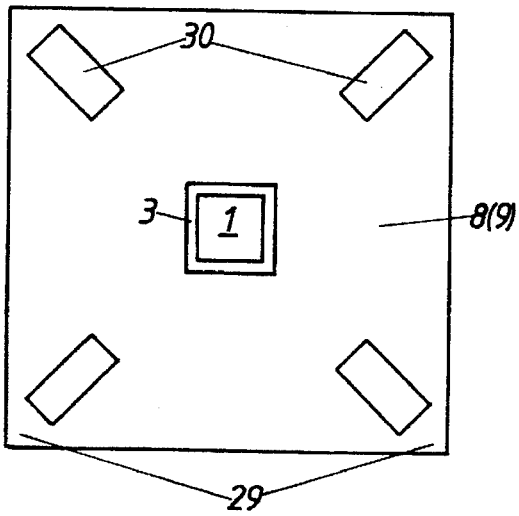
FIG. 8
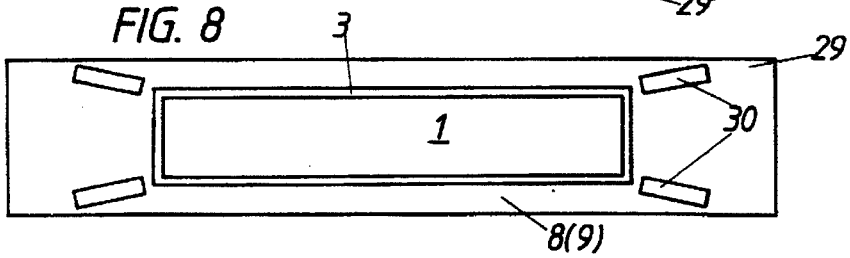

CONTINUOUS CASTING MOLD

BACKGROUND OF THE INVENTION

The invention relates to a continuous casting mold comprising an oscillation means and a guiding means supporting the continuous casting mold relative to a stationary supporting structure and designed as a disc-shaped spring.

A continuous casting mold of this type is known from AT-B-383.521. There, in order to make do with one single light material-saving spring carrier, the spring carrier is disposed at the side of the mold and eccentrically relative to the same and carries a single- or multi-layer diaphragm spring which is supported at the spring carrier by its circumference. In the center of the diaphragm spring a support engages which is mounted on the supporting framework. The spring carrier in turn is connected with the lifting table of the continuous casting mold.

In this construction the oscillation means is formed by eccentric shafts which are driven by corner gears and engage at the corners of the rectangular lifting table via articulation brackets, thus setting the lifting table in vertically directed oscillations. The structural expenditures for the oscillation drive are accordingly high, since the latter in order to absorb the tilting forces occurring due to the eccentric arrangement of the spring carrier has to be constructed so as to be particularly firm and sturdy. Moreover, the eccentric arrangement of the spring carrier calls for some space being provided at one side of the mold.

SUMMARY OF THE INVENTION

The invention has as its object to further develop a continuous casting mold of this type with a view to being able to do with a structurally very simple oscillation means while at the same time ensuring perfect guidance as well as a perfect and precise lifting movement of the continuous casting mold. In particular, the masses to be moved by the oscillation drive are to be substantially reduced and the space required at the side of the mold is to be markedly diminished. Further, converting an existing continuous casting plant into a continuous casting mold according to the invention is to be easy to accomplish, without requiring major structural alterations.

In accordance with the invention this object is achieved in that at least one disc-shaped spring formed as an annular disc peripherally surrounds the continuous casting mold, which annular disc by the inner edge region is connected with the continuous casting mold and by the outer edge region is connected with the stationary supporting structure. Due to the disc-shaped spring being designed as an annular disc peripherally surrounding the mold it is feasible to make do with a stucturally simple oscillation drive. The disc-shaped spring according to the invention may be provided in lieu of the usually employed mold top plate, thus achieving a reduction of the moved masses and enabling the conversion of a conventional continuous casting mold without any major expenses and with only a few parts having to be replaced. Moreover, a lifting table is no longer required.

According to a preferred embodiment, two disc-shaped springs are provided which are arranged at a distance from each other in the direction of the longitudinal center line of the continuous casting mold. In this case, the oscillation drive can be constructed in a particularly simple manner. It is also feasible for the oscillation drive to apply those forces imparting a reciprocating movement to the continuous casting mold to the continuous casting mold asymmetrically with regard to the longitudinal center line of the same.

Suitably, the disc-shaped springs are arranged in planes oriented perpendicular to the longitudinal center line of the continuous casting mold, thus enabling a particularly simple radially symmetric design of the disc-shaped springs, namely in the shape of discs possessing the same thickness over their entire extension.

A preferred embodiment is characterized in that the disc-shaped springs are connected both with the continuous casting mold and with the stationary supporting structure in a liquid-tight manner and the space between the disc-shaped springs is permeated by coolant.

Here—if the disc-shaped springs exhibit different spring constants due to different geometric dimensions and/or different materials—the oscillation means may be provided with a pulsator imparting a pulsating pressure course to the coolant for the continuous casting mold.

The said pulsator then suitably comprises a pump setting the coolant under pressure, preferably a centrifugal pump, and an adjustable throttle, the throttle being alternately switchable between two throttle positions.

Another preferred embodiment of the invention is characterized in that the oscillation means is formed by a pulsator acting between the continuous casting mold and the stationary supporting structure, such as a pressure medium cylinder or an eccentric drive.

In order to achieve a particular ease of installation and removal of the continuous casting mold, the stationary supporting structure comprises a supporting beam peripherally surrounding the continuous casting mold as well as a stationary supporting framework, with the supporting beam being detachably mounted on the supporting framework and together with the continuous casting mold and the disc-shaped spring forming a building block capable of being lifted off the stationary supporting framework and inserted into the same.

Here, the oscillation means suitably is arranged between the supporting beam peripherally surrounding the continuous casting mold and the continuous casting mold and together with the building block formed by the supporting beam peripherally surrounding the continuous casting mold, the continuous casting mold and the disc-shaped spring is capable of being removed from and inserted into the stationary supporting framework.

For optimum coordination of the spring constant with the continuous casting mold the disc-shaped spring is preferably provided with radially oriented thin-wall points or openings, such as slits, in particular in corner regions.

Preferably, the disc-shaped spring exhibits a particularly simple design, namely that of a single-layer diaphragm spring.

With certain strand cross-sections, such as for instance square or rectangular billet or bloom or slab cross sections, it may be suitable for the disc-shaped spring to exhibit an uneven thickness over its circumference and/or its radial extension.

BRIEF DESCRIPTION OF THE DRAWINGS

FIGS. 1 to 4 each illustrate a cross section through a continuous casting mold according to one embodiment each. FIG. 5 diagrammatically illustrates the amount of coolant as a function of the coolant pressure for a preferred embodiment. FIGS. 6, 7 and 8 each illustrate a continuous casting mold in top view according to one embodiment each.

DESCRIPTION OF THE PREFERRED EMBODIMENTS

The continuous casting mold represented in FIG. 1 comprises an internal tube 2 of copper or a copper alloy defining a casting cavity 1 and having a cross section for casting a round or square or rectangular billet or bloom. This internal tube 2 is liquid-tightly inserted in a top flange 3 by its upper end and in a bottom flange 4 by its lower end.

To precisely guide the continuous casting mold relative to a stationary supporting structure 5 peripherally surrounding the continuous casting mold, two disc-shaped springs 8, 9 are provided which are designed as annular discs and arranged parallel to and at a vertical distance 7 with regard to each other, that is, they are spaced apart in the direction of the longitudinal center line 6 of the mold.

Each of the annular discs 8, 9 is by its outer edge region connected with the stationary supporting structure 5, for instance, by screw connections 10. The inner edge region of the upper annular disc 8 is connected with the outer edge region of the top flange 3, and the inner edge region of the lower annular disc 9 is connected with an annular flange 11 connected with the bottom flange 4 and projecting upward from the same. The connections between the annular discs 8, 9 and the stationary supporting structure 5 and/or the top flange 3 and the annular flange 11 are designed liquid-tightly, for instance, likewise in the form of screw connections 10, so that the interior 12 of the continuous casting mold—formed by the stationary supporting structure 5, the two annular discs 8, 9 and the internal tube 2 as well as the top flange 3, the bottom flange 4 and the annular flange 11—may be permeated by coolant.

Both of the disc-shaped springs 8, 9 are radially symmetrical in design and over their entire extension exhibit a constant wall thickness which is dimensioned so as to enable the internal tube 2 of the continuous casting mold to perform a reciprocating movement relative to the stationary supporting structure 5 without exceeding the maximum admissible stretch of the material of the annular discs 8, 9. The annular discs 8, 9 are arranged in planes which are perpendicular with regard to the longitudinal center line 6 of the continuous casting mold.

An oscillation means has two or several pulsators 13 that are likewise disposed radially symmetric relative to the longitudinal center line 6 of the continuous casting mold and formed, for instance, by pressure medium cylinders supported at the stationary supporting structure 5 on the one hand and at supports 14 projecting upward from the bottom flange 4 of the continuous casting mold on the other hand. Within the interior 12 of the continuous casting mold an agitator 16 is provided in addition to installations 15 for diverting the coolant.

The stationary supporting structure 5 includes a supporting beam 17 peripherally surrounding the continuous casting mold—which supporting beam is connected with the annular discs 8, 9—and detachably mounted on a stationary supporting framework 18, such as the pouring platform or a hall structure. After the connection between the supporting beam 17 and the stationary supporting framework 18 has been resolved, the continuous casting mold can be removed from the continuous casting plant together with the supporting beam 17.

In order to enable the removal and insertion of the continuous casting mold in the upward or downward direction respectively, the opening in the supporting framework 18 designated to receive the continuous casting mold is dimensioned larger than the largest horizontal measurement of those portions of the continuous casting mold disposed below the supporting framework 18.

If the oscillation means 13 are supported at the supporting beam 17, as shown in FIG. 1, the continuous casting mold together with its guiding means (annular discs 8, 9) and its oscillation means 13 forms a building block that is compact and particularly easy to remove and insert.

According to the continuous casting mold depicted in FIG. 2 two annular discs 8, 9 are provided which are likewise arranged at a vertical—though reduced—distance 7 from each other and which by their inner regions are connected with a carrying ring 19 mounted on the continuous casting mold and by their outer regions with a supporting beam 17 peripherally surrounding the continuous casting mold, the supporting beam being supported at a stationary supporting framework 18 as according to FIG. 1. With this embodiment the annular discs 8, 9 are not wetted by the coolant but are arranged so as to be isolated from the interior 12 of the continuous casting mold. Along with the carrying ring 19 disposed within and the supporting beam 17 arranged outside they form a building unit easily insertable into and removable from the continuous casting plant. According to this embodiment, the agitator 16 is provided outside the interior 12 of the continuous casting mold that is permeated by the coolant.

According to the embodiment represented in FIG. 3 two annular discs 8, 9 are again arranged at a vertical distance 7 from each other, though spaced less far apart than according to FIG. 1. Here, like in FIG. 1, the two annular discs 8, 9 define the mold interior 12 through which the coolant flows, so that they are likewise connected—in a liquid-tight manner each—with the continuous casting mold and the stationary supporting structure 5—again comprised of a supporting beam 17 and a supporting framework 18. Instead of an oscillation drive formed by pressure medium cylinders 13, here, a lifting crank drive 20 is provided having synchronously driven eccentric shafts.

With the embodiment represented in FIG. 4 which, apart from the oscillation drive, is similar in structure to the embodiment depicted in FIG. 3, the oscillation of continuous casting mold is produced by means of a pulsator which imparts a pulsating pressure course to the coolant for the continuous casting mold, i.e. one periodically fluctuating between a minimum 21 and a maximum value 22. Due to the spring constants of the two disc-shaped springs 8, 9 being unequal, the coolant subjected to these pressure fluctuations causes the continuous casting mold to carry out a reciprocating movement relative to the stationarily supported supporting beam 17.

Here, the pulsator is formed by a pump 23, preferably configured as a centrifugal pump, and a control valve acting as a controllable throttle 24. The coolant circulatory system 25 is fed from a high-level reservoir 26 and comprises a heat exchanger 27 carrying off the heat transmitted from the cast strand to the coolant. The control valve 24 switches between two pressure points 21 and 22. Pressure and amount of water automatically adjust as a function of the characteristic line 28 of the of the centrifugal pump between the two switch points. This is diagrammatically illustrated in FIG. 5, where the amount of coolant Q flowing through the continuous casting mold is shown on the abscissa and the pertaining coolant pressure p on the ordinate.

Instead of the centrifugal pump a multiple cylinder pump may be provided, one of the cylinders of the multiple cylinder pump being controllable to generate the pulsating pressure course of the coolant. In this case, the controllable throttle 24 can be omitted.

Fluctuation in the amount of coolant only negligibly affects the cooling performance as long as a minimum amount of coolant is not fallen short of. By taking measurements of the reciprocating movement of the continuous casting mold, any desired curve course (e.g. a non-sinusoidal course) may be followed via a control circuit not illustrated.

One of the advantages of the embodiment illustrated in FIG. 4 lies in the fact that the pulsator 23, 24 may be arranged at a greater distance from the continuous casting mold, for instance in the media supply room of the continuous casting plant, so as to be well protected and easily accessible, and it will not take up space within the mold area proper.

As can be seen from FIGS. 6 to 8, the continuous casting mold according to the invention may be used both for casting square or rectangular or round billets and blooms and for casting slabs. In the latter case the continuous casting mold may be configured as a plate mold, if desired with adjustable side wall plates, instead of a tubular mold.

The casting cavity 1 may also be curved, wherein the arrangement of the disc-shaped springs 8, 9 suitably is effected in planes which are oriented radially relative to the curved longitudinal center line of the continuous casting mold.

In order to achieve homogenous strain in the corner regions 29 of the annular discs 8, 9 (if shaped to deviate from a circular ring when viewed from above), in the corner regions 29 of the annular discs zones 30 are provided having smaller cross sections, i.e. having a slighter thickness than the other regions of the annular discs. There, slits may also be provided, which in the event that the disc-shaped springs 8, 9 are moistened with coolant (FIGS. 1, 3 and 4) would have to be covered in a liquid-tight manner. The annular discs 8, 9 may be biased for absorbing the weight forces of the continuous casting mold.

What we claimed is:

1. In a continuous casting mold arrangement of the type comprising a continuous casting mold having an oscillation means, a stationary supporting structure and guiding means supporting said casting mold relative to said stationary supporting structure said guiding means comprising disc-shape springs peripherally surrounding said casting mold and adapted to support the continuous casting mold relative to said stationary supporting structure, the improvement wherein at least one disc-shaped spring is an annular disc peripherally surrounding said continuous casting mold, said annular disc having an inner edge region and an outer edge region, and being by the inner edge region connected with the continuous casting mold and by the outer edge region connected with the stationary supporting structure.

2. A continuous casting mold arrangement as set forth in claim 1, wherein two disc-shaped springs are provided which are arranged parallel to and at a distance from each other in the direction of the longitudinal center line of said continuous casting mold.

3. A continuous casting mold arrangement as set forth in claim 2, wherein said disc-shaped springs are arranged in planes oriented perpendicular to the longitudinal center line of the continuous casting mold.

4. A continuous casting mold arrangement as set forth in claim 2, wherein said disc-shaped springs are connected both with said continuous casting mold and with said stationary supporting structure in a liquid-tight manner and said space between said disc-shaped springs is permeated by coolant.

5. A continuous casting mold arrangement as set forth in claim 4, wherein said disc-shaped springs have different spring constants—due to different geometric dimensions—and the oscillation means is provided with a pulsator for imparting a pulsating pressure course to the coolant for the continuous casting mold.

6. A continuous casting mold arrangement as set forth in claim 4, wherein said disc-shaped springs have different spring constants—due to different materials—and said oscillation means is provided with a pulsator for imparting a pulsating pressure course to said coolant for said continuous casting mold.

7. A continuous casting mold arrangement as set forth in claim 4, wherein said disc-shaped springs have different spring constants—due to different geometric dimensions and different materials—and said oscillation means is provided with a pulsator for imparting a pulsating pressure course to said coolant for said continuous casting mold.

8. A continuous casting mold arrangement as set forth in claim 5, wherein said pulsator comprises a pump constructed to set the coolant under pressure and an adjustable throttle capable of being switched between a first throttle position and a second throttle position.

9. A continuous casting mold arrangement as set forth in claim 8, wherein said pump is a centrifugal pump.

10. A continuous casting mold arrangement as set forth in claim 1, wherein said oscillation means is comprised of a pulsator acting between said continuous casting mold and said stationary supporting structure.

11. A continuous casting mold arrangement as set forth in claim 1, wherein said pulsator is a pressure medium cylinder.

12. A continuous casting mold arrangement as set forth in claim 1, wherein said pulsator is an eccentric drive.

13. A continuous casting mold arrangement set forth in claim 1, wherein said stationary supporting structure comprises a supporting beam peripherally surrounding said continuous casting mold as well as a stationary supporting framework, said supporting beam being detachably mounted on said supporting framework and, together with said continuous casting mold and said disc-shaped spring, forming a building block capable of being lifted off said stationary supporting framework and inserted into the same.

14. A continuous casting mold arrangement as set forth in claim 13, wherein said oscillation means is arranged between said supporting beam peripherally surrounding the continuous casting mold and said continuous casting mold and—together with said building block formed by said supporting beam peripherally surrounding the continuous casting mold, the continuous casting mold and the disc-shaped spring—is capable of being removed from and inserted into said stationary supporting framework.

15. A continuous casting mold arrangement as set forth in claim 1, wherein said disc-shaped spring is provided with radially oriented thin-wall points, particularly in corner regions.

16. A continuous casting mold arrangement as set forth in claim 1, wherein said disc-shaped spring is provided with radially oriented openings, such as slits, particularly in corner regions.

17. A continuous casting mold arrangement as set forth in claim 1, wherein said disc-shaped spring is designed as a single-layer diaphragm spring.

18. A continuous casting mold arrangement as set forth in claim 1, wherein said disc-shaped spring exhibits an uneven thickness over its circumference.

19. A continuous casting mold arrangement as set forth in claim 1, wherein said disc-shaped spring exhibits an uneven thickness over its radial extension.

20. A continuous casting mold arrangement as set forth in claim 1, wherein said disc-shaped spring exhibits an uneven thickness over its circumference and its radial extension.

* * * * *